US007162175B2

(12) United States Patent
Umezawa

(10) Patent No.: US 7,162,175 B2
(45) Date of Patent: Jan. 9, 2007

(54) IMAGE FORMING APPARATUS INCLUDING TEMPERATURE SENSOR AND METHOD THEREOF

(75) Inventor: Noriyuki Umezawa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 93 days.

(21) Appl. No.: 10/997,904

(22) Filed: Nov. 29, 2004

(65) Prior Publication Data

US 2006/0115289 A1 Jun. 1, 2006

(51) Int. Cl.
*G03G 15/20* (2006.01)

(52) U.S. Cl. ..... 399/69; 219/216

(58) Field of Classification Search ..... None
See application file for complete search history.

(56) References Cited

U.S. PATENT DOCUMENTS 4,873,549 A 10/1989 Tada et al.
5,465,141 A * 11/1995 Asano et al. ..... 399/69
5,903,810 A 5/1999 Adachi
5,999,764 A * 12/1999 Okabayashi et al. ..... 399/67
6,298,213 B1 * 10/2001 Miyamoto et al. ..... 399/320
6,377,778 B1 4/2002 Kikuchi et al.
6,643,491 B1 11/2003 Kinouchi et al.
7,106,985 B1 * 9/2006 Sone et al. ..... 399/69

FOREIGN PATENT DOCUMENTS

| | | |
|---|---|---|
| JP | 7-247044 | 9/1995 |
| JP | 9-30703 | 2/1997 |
| KR | 2000-34874 | 6/2000 |
| KR | 2000-53532 | 8/2000 |

* cited by examiner

*Primary Examiner*—Quana Grainger
(74) *Attorney, Agent, or Firm*—Foley & Lardner LLP

(57) ABSTRACT

A fixing device for an image forming apparatus includes a heating roller and a press roller. The press roller is pressed against the heating roller, and the heating roller and the press roller operate to fix an image on a document. The fixing device also includes a heat source that heats the heating roller. The heat source is configured to activate to heat the heating roller substantially when the heating roller and the press roller start to rotate, independent of a temperature of the heating roller.

22 Claims, 5 Drawing Sheets

IMAGE FORMING APPARATUS INCLUDING TEMPERATURE SENSOR AND METHOD THEREOF

FIELD OF THE INVENTION

The present invention relates generally to an image forming apparatus. More particularly, the present invention relates to an image forming apparatus having a fuser with reduced temperature fluctuation.

BACKGROUND OF THE INVENTION

Generally, an image forming apparatus includes a fuser that operates to fix an image on a document. The fuser typically includes of a pair of rollers, i.e., a heating roller and a press roller. The heating roller includes a heat source, and the press roller is pressed against the heating roller. As the document passes between the heating roller and the press roller, heat from the heat source fuses toner adhering to the document onto the document.

The wall of the heating roller is typically thin to reduce the time required for the heat source to warm up the heating roller. However, the thin wall of the heating roller has a small heat capacity so that the wall's ability to retain heat is diminished. Thus, at the start of a print operation when the rollers begin rotating, heat is transferred from the heating roller to the unheated press roller. Specifically, heat is transferred from the portions of the heating roller wall that come into contact with the cool press roller at a nip position of the rollers as the rollers rotate, resulting in an initial temperature fluctuation of the heating roller.

In a conventional image forming apparatus, a sensor that detects the temperature of the heating roller and activates the heat source when the temperature reaches a lower threshold is located at a fixed rotational angle beyond the nip position in a direction of rotation of the heating roller. Thus, when the rollers start rotating, the heating roller must rotate through the fixed rotational angle before a cool portion of the heating roller, that contacts the cool press roller at the nip position, reaches the sensor. The heat source is not activated until the sensor senses the cool portion of the heating roller. Therefore, activation of the heat source is delayed until the heating roller rotates through the fixed rotational angle so that the temperature of the heating roller is initially unstable. In other words, the heat source does not sufficiently compensate for the initial temperature fluctuation.

The insufficient compensation results in a risk that the heating roller will not be warm enough for proper printing, and the printing operation may keep the heating roller below the desired fixation temperature. Therefore, a need exists for better heating control of the start of a print operation.

SUMMARY OF THE INVENTION

An aspect of the present invention relates to a fixing device for an image forming apparatus. The fixing device includes a heating roller and a press roller. The press roller is pressed against the heating roller, and the heating roller and the press roller operate to fix an image on a document. The fixing device also includes a heat source that heats the heating roller. The heat source is configured to activate to heat the heating roller before or substantially when the heating roller and the press roller start to rotate, independent of a temperature of the heating roller.

Another aspect of the present invention relates to an image forming apparatus that includes a heating roller and a press roller pressed against the heating roller. The heating roller and the press roller operate to fix an image on a document. The image forming apparatus also includes a heat source that heats the heating roller. The heat source is configured to activate to heat the heating roller when the image forming apparatus receives a start command to perform an image forming operation, independent of the temperature of the heating roller.

Yet another aspect of the present invention relates to a method of forming an image on a media. The method includes providing a heating roller having a heat source that heats the heating roller and providing a press roller pressed against the heating roller. The heating roller and the press roller operate to fix an image on a document. The method further includes initiating rotation of the heating roller and the press roller and activating the heat source at that time independent of a temperature of the heating roller.

Further features, aspects, and advantages of the present invention will become apparent from the detailed description of preferred embodiments that follows when considered together with the accompanying figures.

DETAILED DESCRIPTION OF PREFERRED EMBODIMENTS

Figure 1:
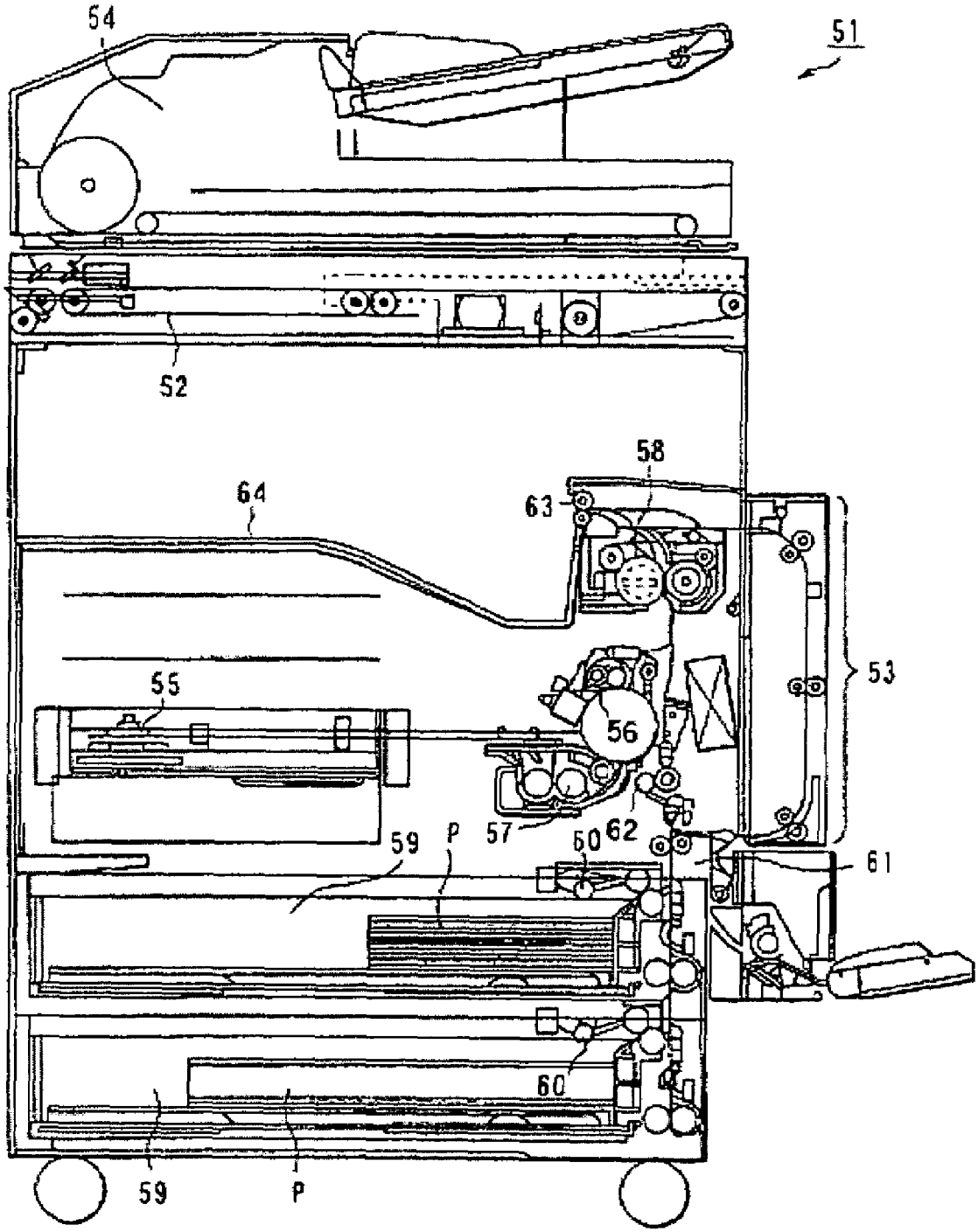
FIG. 1 is an schematic side elevational view of an image forming apparatus consistent with the present invention.

FIG. 1 shows a typical imaging forming apparatus that includes a fuser (or fixing apparatus), as described in U.S. Pat. No. 6,643,491, which is incorporated by reference herein. It will be understood by those skilled in the art that any type of image forming apparatus (including a printer, a copier, or a multifunction peripheral) can be used in accordance with the present invention.

According to an embodiment of the present invention, a fusing device or fuser 10 for an image forming apparatus includes a heating roller 20, a press roller 30, a heat source 40, and a sensor 50.

Figure 2:
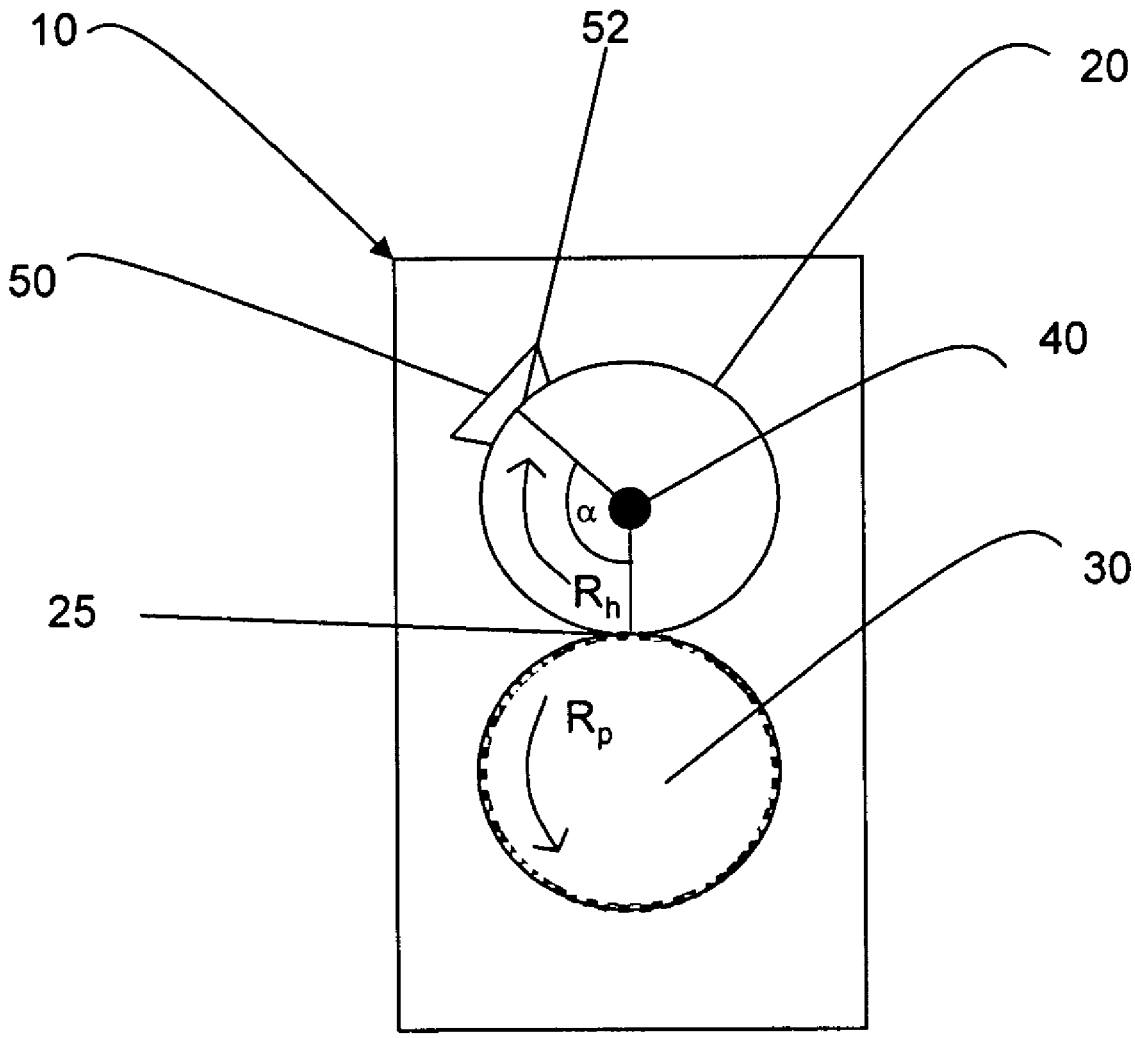
FIG. 2 is a schematic side elevational view of an embodiment of a fuser for an image forming apparatus according to the present invention.

The heating roller 20 and the press roller 30 are configured to receive a document (e.g., a sheet of media, such as paper or transparent film) and to fix an image on the document. As shown in FIG. 2, the heating roller 20 is disposed adjacent to the press roller 30. The press roller 30 is pressed against the heating roller 20 at a nip position 25. Thus, the heating roller 20 and the press roller 30 are in pressing contact at the nip position 25.

The heating roller 20 and the press roller 30 are configured to rotate relative to one another. As shown in FIG. 2, a direction of rotation $R_h$ of the heating roller 20 is opposite a direction of rotation $R_p$ of the press roller 30 so that a document received between the heating roller 20 and the press roller 30 is fed between the heating roller 20 and the press roller 30. The heating roller 20 and the press roller 30 are preferably configured to start rotating when the image forming apparatus receives a start command to perform an image forming operation, such as a print or copy operation. The start command may be generated, for example, when a user presses a start button on the image forming apparatus.

The heat source 40 is configured to heat the heating roller 20 so that toner adhering to the document is fused onto the document as the document passes between the heating roller 20 and the press roller 30. The heat source 40 is preferably disposed in the heating roller 20, as shown in FIG. 2. The heat source 40 may be, for example, a halogen lamp or an IH coil. The heat source 40 is configured to activate and heat the heating roller 20, and to deactivate to discontinue heating the heating roller 20, based on a temperature of the heating roller 20 as sensed by the sensor 50.

The sensor 50 is configured to detect (sense) a temperature of the heating roller 20 at a sensing position 52. As shown in FIG. 2, the sensing position 52 is located at a fixed rotational angle $\alpha$ from the nip position 25 in the direction of rotation $R_h$ of the heating roller 20. The temperature detected by the sensor 50 is used to determine whether to activate or deactivate the heat source 40.

For example, during a standby period and/or during an image forming operation (such as a print or copy operation), the image forming apparatus may be placed in a fixation temperature control mode. In the fixation temperature control mode, the heat source 40 is configured to activate and deactivate to maintain the temperature of the heating roller 20 within a preset temperature range T1 to T2. For example, the preset temperature range can be 195 degrees Celsius (T1) to 205 degrees Celsius (T2). In the fixation temperature control mode, the heat source 40 activates when the detected temperature falls below T1 and deactivates when the detected temperature reaches T2. Thus, during the fixation temperature control, the sensor 50 works in conjunction with the heat source 40 to maintain the temperature of the heating roller 20 at a fixation temperature (e.g., 200 degrees Celsius±5 degrees Celsius).

Figure 3:
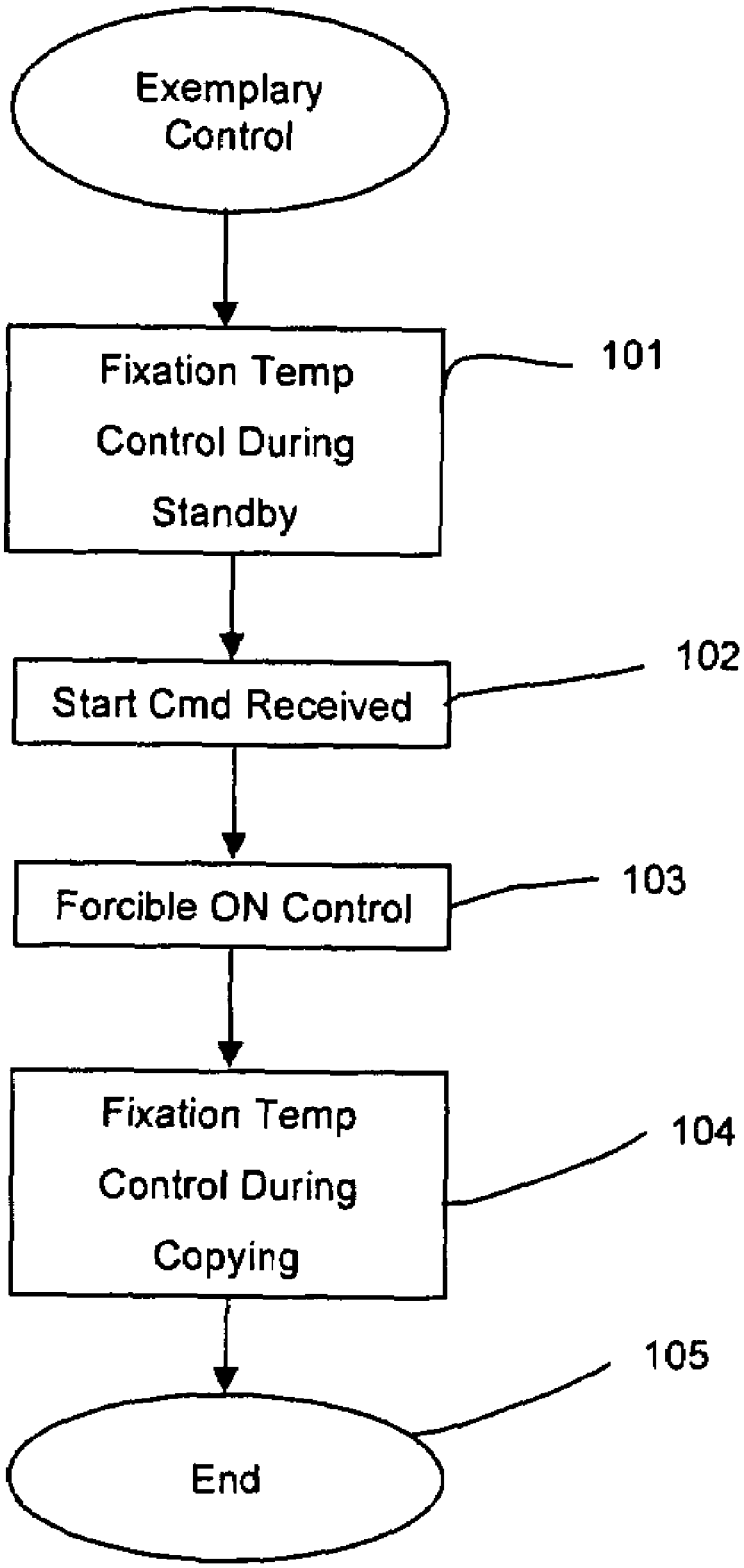
FIG. 3 is a flowchart showing operation of an exemplary control mode of an embodiment of an image forming apparatus according to the present invention.

According to an embodiment, the image forming apparatus (machine) can be placed in an exemplary control mode, as shown in FIG. 3. In this control mode, the image forming apparatus is in the fixation temperature control mode during the standby period (step 101). When the image forming apparatus receives a start command to perform an image forming operation (step 102), a forcible ON control, as described in detail below, is initiated (step 103). The start command is preferably generated when a user presses a start button on the image forming apparatus. At the completion of the forcible ON control, the image forming apparatus returns to the fixation temperature control mode during the image forming operation (e.g., copying or printing) (step 104) until the copying is completed (step 105) and the machine eventually reverts back to standby.

Figure 4:
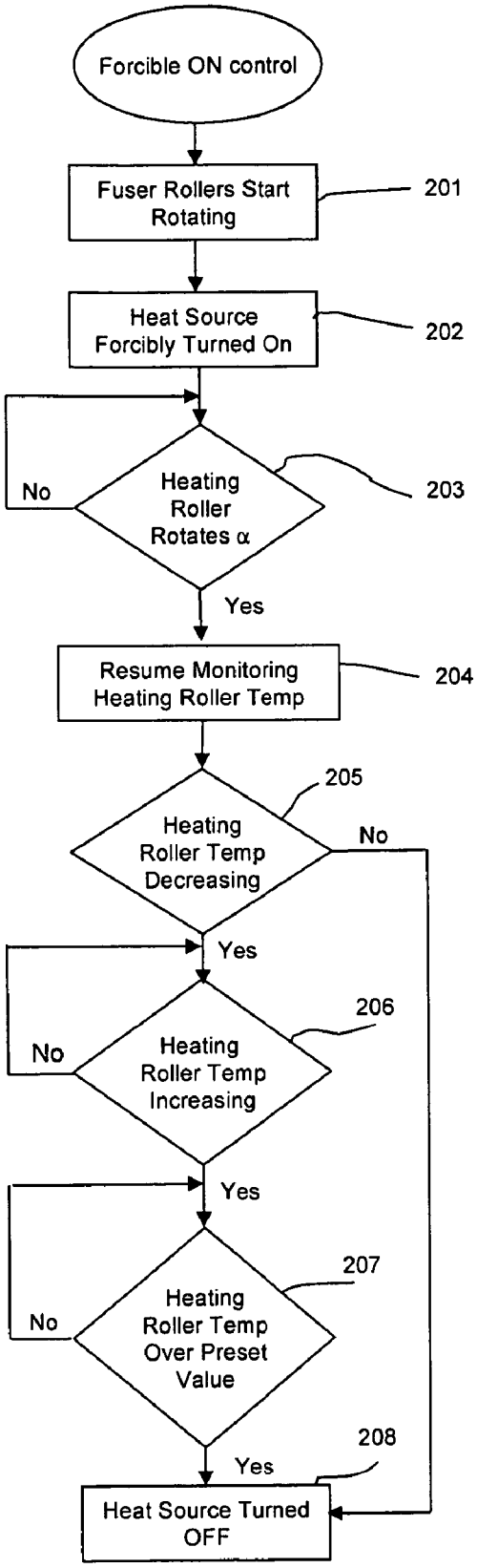
FIG. 4 is a flow chart showing operation of a forcible ON control of the flowchart of FIG. 3 according to an embodiment of the present invention.

An embodiment of the forcible ON control is illustrated in FIG. 4. In addition to working in conjunction with the sensor 50 (i.e., fixation temperature control), the heat source 40 is configured to activate independent of the heating roller 20 temperature (i.e., forcible ON control). According to one embodiment, the heat source 40 activates when or substantially when the heating roller 20 and the press roller 30 (the fuser rollers) start to rotate. As illustrated in FIG. 4, the heat source 40 is forcibly turned on at, and in response to, the start of rotation of the fuser rollers (steps 201 and 202). The heat source 40 is turned on regardless of the temperature detected by the sensor 50. The heat source 40 remains on (activated) for at least a forcible ON period. The forcible ON period may be set as the period during which the heating roller 20 rotates by the fixed rotational angle $\alpha$ (i.e., rotates from the nip position 25 to the sensing position 52). The fixed rotational angle $\alpha$ may be, for example, approximately 240 to 270 degrees. After the heating roller 20 rotates by the angle $\alpha$ (step 203), then the heat source 40 is activated or deactivated based on the temperature detected by the sensor 50 in a manner outlined below. In other words, after the heating roller 20 rotates by the angle $\alpha$, control of the heat source 40 becomes dependent on the temperature detected by the sensor 50 (step 204 and following steps).

As one implementation of the foregoing, if (a) the heating roller 20 rotates by the fixed rotational angle $\alpha$ (or by more than the angle $\alpha$) (step 203) and (b) after such rotation the sensor 50 detects a constant or increasing temperature for the heating roller 20 (i.e., the temperature is not decreasing or falling off) (step 205), the heat source 40 deactivates (step 208). Alternatively, instead of deactivating the heat source 40 as soon as condition (b) is satisfied, deactivation of the heat source 40 may be based on the detected temperature reaching a desired preset value (e.g., 205 degrees Celsius or 210 degrees Celsius). When the detected temperature reaches the desired preset value, the press roller 30 is determined to be sufficiently warm for the pressing operation. After deactivation of the heat source 40, fixation temperature control may resume (e.g., as shown in step 104 of FIG. 3).

Conversely, if (a) the heating roller 20 rotates by the fixed rotational angle $\alpha$ (or by more than the angle $\alpha$) (step 203) and (c) after such rotation the sensor 50 detects that the temperature of the heating roller 20 is decreasing (falling off) (step 205), the heat source 40 may remain activated at least until the detected temperature reaches a predetermined (preset) value (e.g., a temperature greater than 200 degrees Celsius, such as 205 degrees Celsius). As one specific example of this general approach, the heat source 40 can be configured to deactivate if, (i) after the sensor 50 detects the initial decreasing temperature once the heating roller rotates by the angle $\alpha$ (steps 203 and 205), (ii) the sensor 50 then detects a second temperature change that is increasing (step 206), and (iii) the detected temperature then reaches or exceeds the predetermined value (step 207). When the detected temperature reaches or exceeds the predetermined value, the heat source 40 may be deactivated. After deactivation of the heat source 40, fixation temperature control may resume (e.g., as shown in step 104 of FIG. 3). The predetermined temperature may be, for example, a temperature greater than 200 degrees Celsius, such as 205 degrees Celsius.

In this manner, temperature fluctuation of the heating roller 20 due to unwanted heat transfer to the press roller 30 is reduced, and the heating roller 20 is maintained at the desired fixation temperature, including during the initial rotation through the angle $\alpha$.

According to another embodiment of the present invention, the forcible ON control can be configured so that after the heating roller 20 rotates by the fixed rotational angle $\alpha$, the heat source 40 remains activated as long as the sensor 50 detects that the detected temperature is below a predetermined value. The predetermined value can be, for example, a temperature below 200 degrees Celsius, such as 195 degrees Celsius. In this manner, temperature fluctuation of the heating roller 20 is reduced, and the temperature of the heating roller 20 is prevented from falling below the fixation temperature.

According to another embodiment of the present invention, the forcible ON control is configured so that after the heating roller 20 rotates by the fixed rotational angle α, the heat source 40 remains activated for at least a predetermined period of time and deactivates if, after this predetermined period, the detected temperature then rises to reach a predetermined value. The predetermined value may be, for example, 195 degrees Celsius. The predetermined period of time may be set so that the heat source 40 remains activated a sufficient amount of time to counteract a large fluctuation (fall quantity) in the temperature of the heating roller 20 due to heat transfer to the low temperature press roller 30. In this manner, the temperature of the heating roller 20 is prevented from dropping substantially below the fixation temperature. The value of the predetermined period of time depends on the parameters of the image forming apparatus and process, such as the speed of the image forming process and the diameter of the heating roller 20. A typical value for the predetermined period of time may be, for example, approximately 0.8 to 1.0 seconds. For a high speed image forming apparatus the predetermined period of time may be approximately half of the typical value (e.g., 0.4 to 0.5 seconds). Conversely, for a low speed image forming apparatus, the predetermined period of time may be approximately twice the typical value (e.g., 1.6 to 2.0 seconds).

Thus, according to the above-described embodiments, a method of forming an image on a media includes providing a heating roller 20 having a heat source 40 that heats the heating roller 20, providing a press roller 30 pressed against the heating roller 20, initiating rotation of the heating roller 20 and the press roller 30, and activating the heat source 40 independent of the heating roller 20 temperature. The method can additionally include activating the heat source 40 when the heating roller 20 and the press roller 30 begin to rotate or when the image forming apparatus receives the start command.

In the foregoing embodiment of FIG. 4, the forcible ON control turns on the heat source 40 when the fuser rollers begin rotating. In an alternative embodiment, the forcible ON control may turn on the heat source 40 when or substantially when a start command for an image forming operation is detected, which may be when the user presses a start button. After activation of the heat source 40, this alternative embodiment follows steps 203 to 208 of FIG. 4 and then commences the fixation temperature control during copying.

Figure 5:
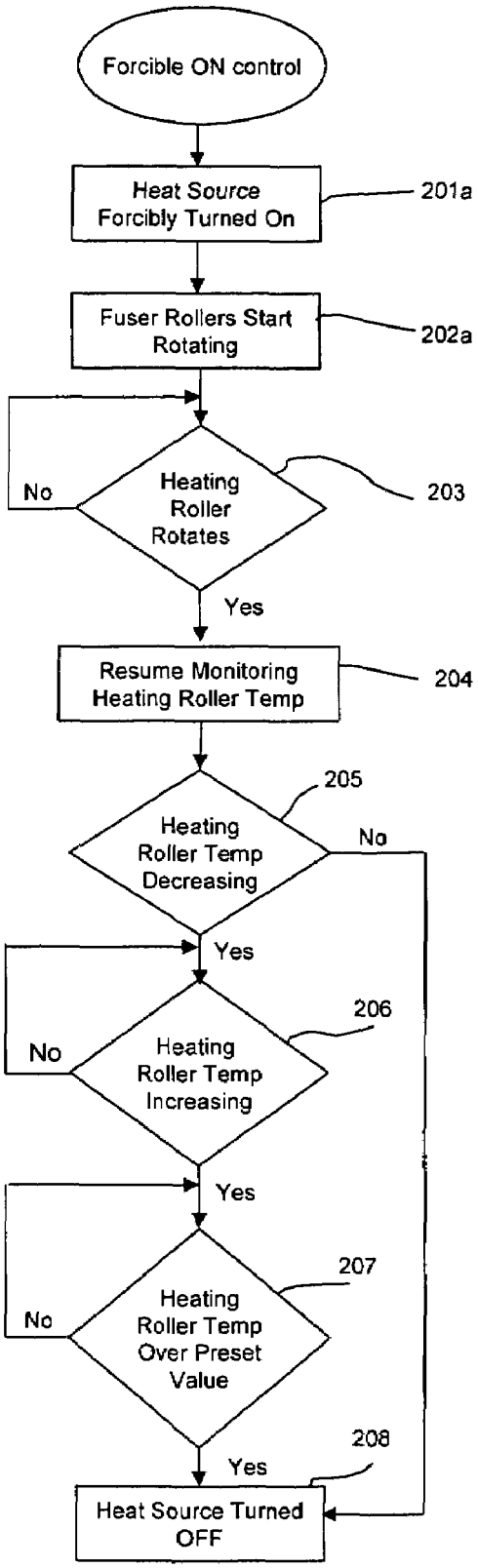
FIG. 5 is a flow chart showing operation of a forcible ON control of the flowchart of FIG. 3 according to another embodiment of the present invention.

In another alternative, and preferred, embodiment, the forcible ON control turns on the heat source 40 before the fuser rollers begin rotating as illustrated in FIG. 5 (steps 201*a* and 202*a*). The embodiment of FIG. 5 then follows steps 203 to 208 of FIG. 4 (which are also shown in FIG. 5) and then commences the fixation temperature control during copying.

Thus, according to the embodiments described above, an image forming apparatus having a fuser with reduced temperature fluctuation at the start of a print or copy operation is provided.

Modifications and other embodiments of the invention will be apparent to those skilled in the art from consideration of the specification and practice of the invention disclosed herein. It is intended that the specification and examples be considered as exemplary only, the scope of the invention being limited only by the appended claims.

What is claimed is:

1. A fixing device for an image forming apparatus, comprising:

a heating roller;

a press roller pressed against the heating roller, wherein the heating roller and the press roller operate to fix an image on a document;

a heat source that heats the heating roller, wherein the heat source is configured to activate to heat the heating roller before or substantially when the heating roller and the press roller start to rotate, independent of a temperature of the heating roller; and a sensor that detects the temperature of the heating roller, wherein a sensing position of the sensor is disposed a fixed rotational angle from a nip position of the heating roller and press roller, wherein the heat source is configured to stay activated for at least a time period that the heating roller rotates by the fixed rotational angle, and wherein, after the heating roller rotates by the fixed rotational angle, the heat source is configured to activate or deactivate based on the temperature detected by the sensor.

2. The fixing device of claim 1, wherein, after the heating roller rotates by the fixed rotational angle, the heat source is configured to remain activated as long as the sensor detects that the detected temperature is below a predetermined value.

3. The fixing device of claim 1, wherein the heat source is configured to remain activated for at least a predetermined period of time after the heating roller rotates by the fixed rotational angle, and is configured to deactivate when the detected temperature thereafter is at least a predetermined value.

4. The fixing device of claim 1, wherein, after the heating roller rotates by the fixed rotational angle, the heat source is configured to be activated and deactivated to maintain a temperature of the heating roller within a preset temperature range.

5. The fixing device of claim 4, wherein the preset temperature range is 195 degrees Celsius to 205 degrees Celsius.

6. The fixing device of claim 4, wherein the preset temperature range is 205 degrees Celsius to 215 degrees Celsius.

7. The fixing device of claim 1, wherein the heat source is configured to activate to heat the heating roller substantially when the heating roller and the press roller start to rotate, independent of a temperature of the heating roller.

8. A fixing device for an image forming apparatus, comprising:

a heating roller;

a press roller pressed against the heating roller, wherein the heating roller and the press roller operate to fix an image on a document;

a heat source that heats the heating roller, wherein the heat source is configured to activate to heat the heating roller before or substantially when the heating roller and the press roller start to rotate, independent of a temperature of the heating roller, and a sensor that detects the temperature of the heating roller, wherein a sensing position of the sensor is disposed a fixed rotational angle from a nip position of the heating roller and press roller, wherein the heat source is configured to deactivate if the heating roller rotates by more than the fixed rotational angle and the sensor detects a constant or increasing temperature of the heating roller.

9. A fixing device for an image forming apparatus, comprising:

a heating roller:

a press roller pressed against the heating roller, wherein the heating roller and the press roller operate to fix an image on a document;

a heat source that heats the heating roller, wherein the heat source is configured to activate to heat the heating roller before or substantially when the heating roller and the press roller start to rotate, independent of a temperature of the heating roller, and a sensor that detects the temperature of the heating roller, wherein a sensing position of the sensor is disposed a fixed rotational angle from a nip position of the heating roller and press roller, wherein, after the heating roller rotates by the fixed rotational angle, the heat source is configured to remain activated if the sensor detects that the detected temperature of the heating roller is decreasing, and wherein the heat source remains activated at least until the detected temperature reaches a predetermined value.

10. The fixing device of claim 9, wherein the heat source is deactivated when the detected temperature reaches the predetermined value.

11. The fixing device of claim 9, wherein the heat source is configured to deactivate if, after the sensor detects a decreasing temperature, the sensor detects a second temperature change that is increasing and the detected temperature then reaches the predetermined value.

12. The fixing device of claim 11, wherein the predetermined value is 200 degrees Celsius.

13. The fixing device of claim 11, wherein the predetermined value is 205 degrees Celsius.

14. An image forming apparatus, comprising:

a heating roller;

a press roller pressed against the heating roller, wherein the heating roller and the press roller operate to fix an image on a document;

a heat source that heats the heating roller, wherein the heat source is configured to activate to heat the heating roller when the image forming apparatus receives a start command to perform an image forming operation, independent of the temperature of the heating roller; and a sensor that detects the temperature of the heating roller, wherein a sensing position of the sensor is disposed a fixed rotational angle from a nip position of the heating roller and press roller, wherein the heat source is configured to stay activated for at least a time period that the heating roller rotates by the fixed rotational angle, and wherein, after the heating roller rotates by the fixed rotational angle, the heat source is configured to activate or deactivate based on the temperature detected by the sensor.

15. The image forming apparatus of claim 14, wherein the start command is generated when a user presses a start button on the image forming apparatus.

16. The image forming apparatus of claim 14, wherein the heat source is configured to deactivate if the heating roller rotates by more than the fixed rotational angle and the sensor detects a constant or increasing temperature of the heating roller.

17. The image forming apparatus of claim 14, wherein, after the heating roller rotates by the fixed rotational angle, the heat source is configured to remain activated if the sensor detects that the detected temperature of the heating roller is decreasing, and wherein the heat source remains activated at least until the detected temperature reaches a predetermined value and then deactivates.

18. The image forming apparatus of claim 14, wherein, after the heating roller rotates by the fixed rotational angle, the heat source is configured to remain activated as long as the sensor detects that the detected temperature is below a predetermined value.

19. A method of forming an image on a media, the method comprising the steps of:

providing a heating roller having a heat source that heats the heating roller;

providing a press roller pressed against the heating roller, wherein the heating roller and the press roller operate to fix an image on a document;

initiating rotation of the heating roller and the press roller;

activating the heat source independent of a temperature of the heating roller; and detecting the temperature of the heating roller using a sensor disposed at a sensing position at a fixed rotational angle from a nip position of the heating roller and press roller, wherein the step of activating the heat source includes activating the heat source for at least a time period that the heating roller rotates by the fixed rotational angle, and after the heating roller rotates by the fixed rotational angle, activating or deactivating the heat source based on the temperature detected by the sensor.

20. The method of claim 19, wherein the step of activating the heat source includes activating the heat source substantially when the heating roller and the press roller begin to rotate.

21. The method of claim 19, wherein the step of activating the heat source includes activating the heat source substantially when a start command for an image forming operation is received.

22. The method of claim 19, wherein the step of activating the heat source includes activating the heat source before the heating roller and the press roller begin to rotate.

* * * * *